US007107809B2

(12) United States Patent
Wang et al.

(10) Patent No.: US 7,107,809 B2
(45) Date of Patent: Sep. 19, 2006

(54) METHOD FOR SHAPING A SEAMLESS ALUMINUM WHEEL RIM

(76) Inventors: Ting-Fang Wang, No. 62, Lane 142, Sec. 1, Yung An S. Rd., Lu Chou, Taipei Hsien (TW); Juei-Hung Hung, No. 62, Lane 142, Sec. 1, Yung An S. Rd., Lu Chou, Taipei (TW)

( * ) Notice: Subject to any disclaimer, the term of this patent is extended or adjusted under 35 U.S.C. 154(b) by 315 days.

(21) Appl. No.: 10/644,946

(22) Filed: Aug. 19, 2003

(65) Prior Publication Data

US 2004/0099037 A1 May 27, 2004

(30) Foreign Application Priority Data

Nov. 21, 2002 (TW) ..... 91133965 A

(51) Int. Cl.
*B21D 22/00* (2006.01)

(52) U.S. Cl. ..... 72/348; 29/894.353

(58) Field of Classification Search ..... 72/367.1, 72/353.4, 353.6, 348, 68, 894.353, 894.35; 29/894.35, 894.353, 894.354
See application file for complete search history.

(56) References Cited

U.S. PATENT DOCUMENTS 4,985,993 A * 1/1991 Yagi et al. ..... 29/894.353
6,244,668 B1 * 6/2001 Hale et al. ..... 301/95.105
6,757,976 B1 * 7/2004 Baek ..... 29/894.322

FOREIGN PATENT DOCUMENTS

GB 1457778 A * 12/1976

* cited by examiner

*Primary Examiner*—Derris H. Banks
*Assistant Examiner*—Teresa M. Bonk

(57) ABSTRACT

A method for manufacturing a seamless wheel rim includes the steps of deeply drawing a pre-cut circular aluminum alloy plate into a cup-shaped embryo body, punching out the bottom surface thereof to form a hollow cylinder, then putting it into an expanding-pressing female die with an expanding die cavity at both ends thereof respectively, and finally pressing and expanding both ends of the embryo body by two sets of expanding-pressing male dies to form a seamless aluminum wheel rim in sequence.

2 Claims, 4 Drawing Sheets

METHOD FOR SHAPING A SEAMLESS ALUMINUM WHEEL RIM

BACKGROUND OF THE INVENTION

1. Field of the Invention

The present invention relates to a method for manufacturing a vehicle wheel rim, which is simpler and lower cost than a conventional manufacturing method.

2. The Related Art

In the considerations of reducing the weight of a vehicle body and promoting its control and appearance, a vehicle wheel rim is mostly manufactured by using aluminum alloy material now. Although a conventional method can manufacture a superior performance and appearance of aluminum wheel rim, it still has some defects, For example the strength thereof cannot be further increased, the manufacturing processes thereof are too complicate, and the manufacturing cost thereof cannot be reduced. Three conventional methods for manufacturing an aluminum wheel rim and the defects thereof in reference to the accompanying drawings are described as the followings.

FIG. 1 shows a first conventional gravity casting method for manufacturing an aluminum wheel rim. A wheel-rim-shaped mold cavity A1 is pre-designed in a foundry mold A. Then a melting aluminum alloy is poured into the mold cavity A1. After being cooled, the casting is taken out from the mold A and is processed through a heat treatment and machining procedures to form a wheel rim. However using a foundry mold to manufacture a wheel rim, it easily produces sand holes due to the melting aluminum alloy containing airs. When it is mounted to a wheel tire, a leak will occur. In addition, due to micron sand holes, it is hard to manufacture a wheel rim with chromate treatment to meet market requirements. That further results in a drawback of high manufacturing cost of wheel rim with chromate treatment.

FIG. 2 shows a second conventional welding and spinning method for manufacturing an aluminum wheel rim. Firstly, a rectangular aluminum alloy plate B is rolled up by a rolling machine to form a cylindrical shell B1, then joint the two ends thereof together by a welding process, and finally shape it into a wheel rim B2 by a spinning machine. However this method needs rolling up, welding and spinning procedures so that the manufacturing time and cost thereof are relatively higher. Furthermore, the strength thereof is weaker than that of a wheel rim manufactured by the present invention.

FIG. 3 shows a third conventional spinning method for manufacturing an aluminum wheel rim, which first manufactures two wheel rim parts and then mounts them together using fixing devices. Firstly, two different sizes of aluminum alloy plates C are respectively spun into a first wheel rim pan C1 and a second wheel rim, part C2. The first wheel rim part C1 and the second wheel rim part C2 are then jointed together through a wheel disc, bolts and nuts. However the third method needs two times of spinning, drilling and jointing procedures. Therefore the manufacturing time thereof cannot be further reduced. The condition of being leaky or even loose of the wheel rim may occur due to vibration in the movement of vehicles. And the strength thereof is weaker than that of a wheel rim manufactured by the present invention.

In view of the defects of the above conventional methods for manufacturing an aluminum wheel rim, the present invention provides with a more superior method to manufacture a higher strength, better performance and lower cost of wheel rim.

SUMMARY OF THE INVENTION

The present invention is to solve the problem that a wheel rim manufactured by conventional methods has a higher manufacturing cost, the strength thereof cannot be further increased and the weight thereof is heavier.

A method for manufacturing a seamless wheel rim in accordance with the present invention is to first deeply draw a pre-cut circular aluminum alloy plate into a cup-shaped embryo body, punch out the bottom surface thereof to form a hollow cylinder, then put it into an expanding-pressing female die with an expanding die cavity at both ends thereof respectively, and finally press and expand the both ends of the embryo body by two sets of expanding-pressing male dies to form a seamless aluminum wheel rim in sequence.

An object of a method for shaping a seamless aluminum wheel rim in accordance with the present invention is to provide with a one-mold construction wheel rim without seams on the surface thereof so that the strength thereof can be increased and there is no leak problem.

A second object of the method for shaping a seamless aluminum wheel rim in accordance with the present invention is to use a fewer machine equipments and less manufacturing time to manufacture a more superior wheel rim and reduce the manufacturing cost thereof.

Another object of the method for shaping a seamless aluminum wheel rim in accordance with the present invention is to promote the strength of an aluminum wheel rim to meet the requirement of a large size of vehicle wheel with lightweight. For example, a 24" casting wheel rim weighs 24 kilograms but a same size wheel rim manufactured by the present invention weighs only 18 kilograms.

DETAILED DESCRIPTION OF THE PREFERRED EMBODIMENT

Figure 1:
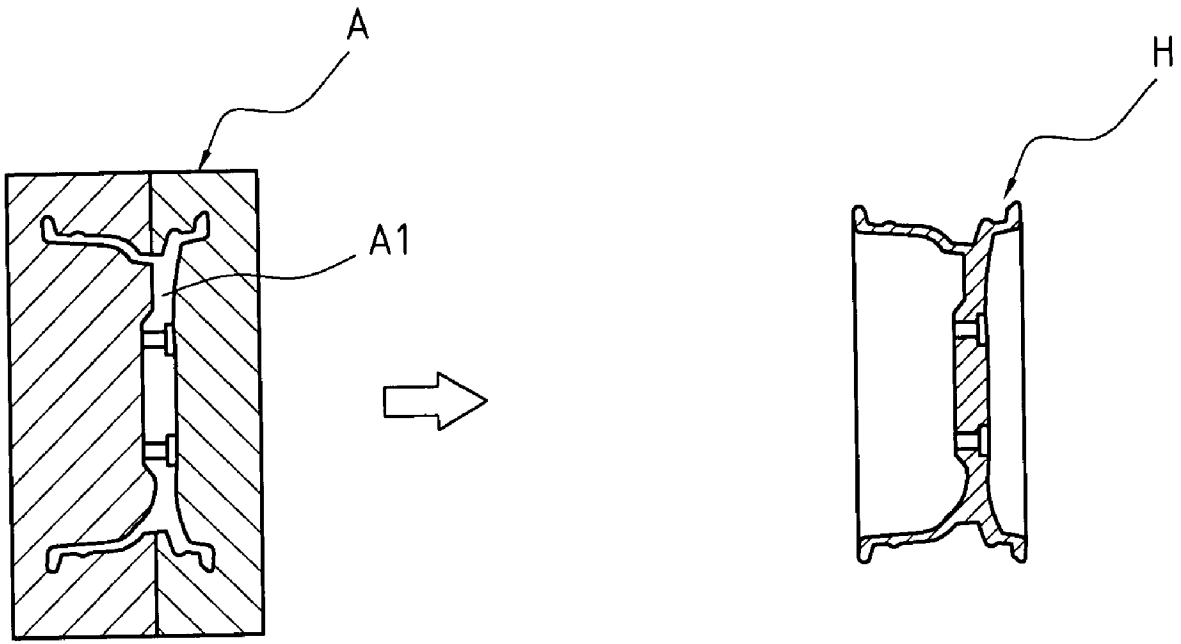
FIG. 1 is a schematic diagram showing a manufacturing process of a conventional gravity casting method for manufacturing a wheel rim and the structure thereof.
Figure 2:
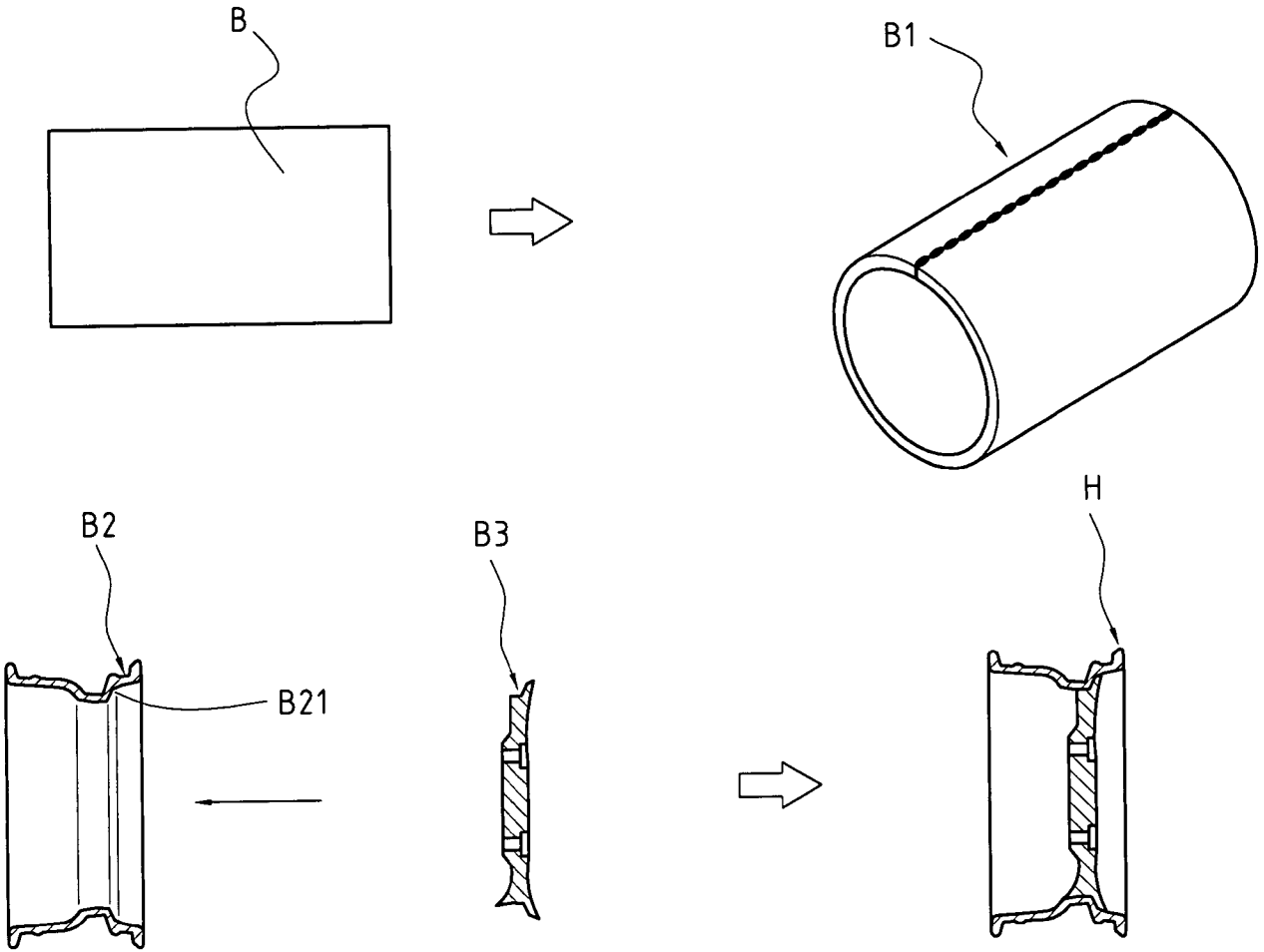
FIG. 2 is a schematic diagram showing a manufacturing process of a conventional welding and spinning method for manufacturing a wheel rim and the structure thereof.
Figure 3:
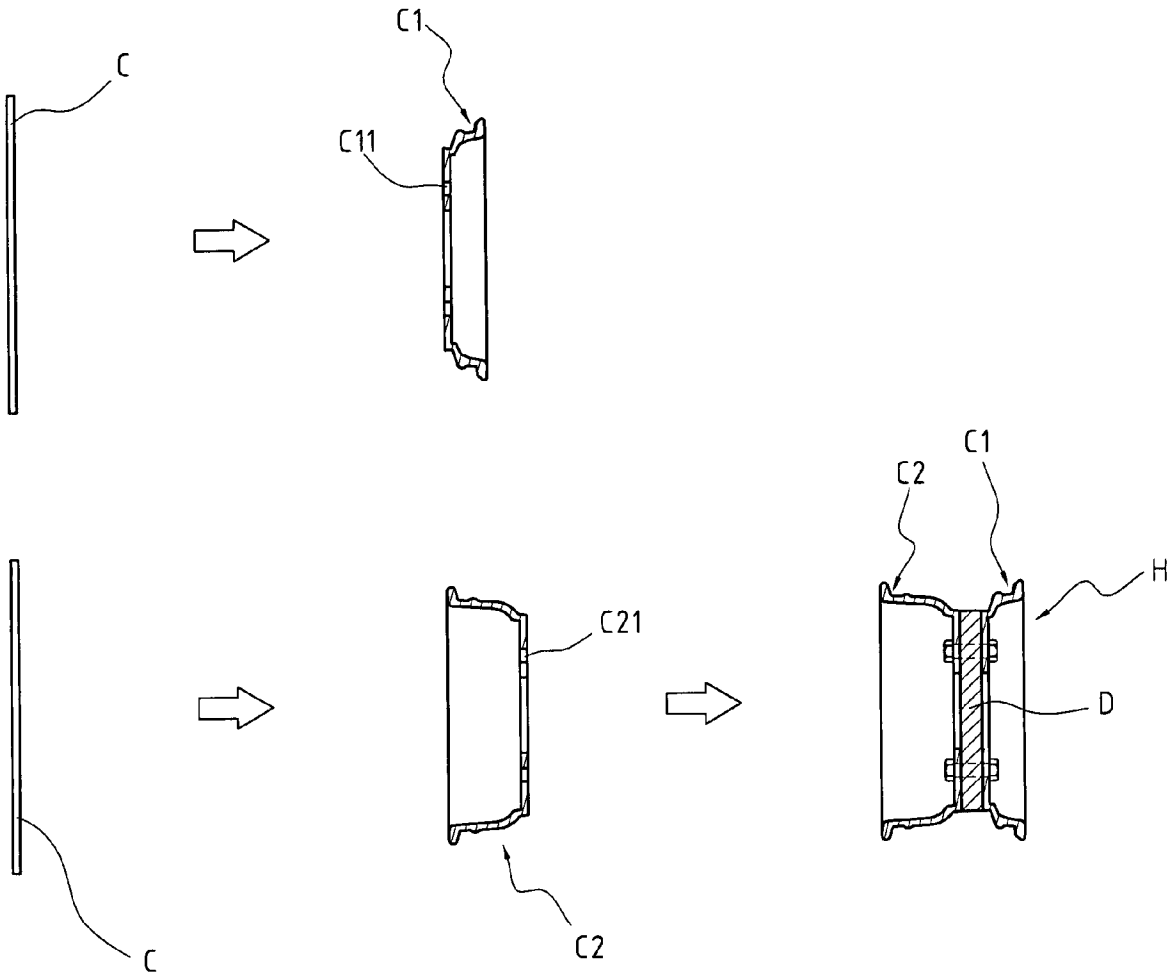
FIG. 3 is a schematic diagram showing a manufacturing process of a conventional spinning method for manufacturing a wheel rim, which first manufactures two wheel rim parts and then joints them together by a wheel disc in combination with bolts and nuts.
Figure 4:
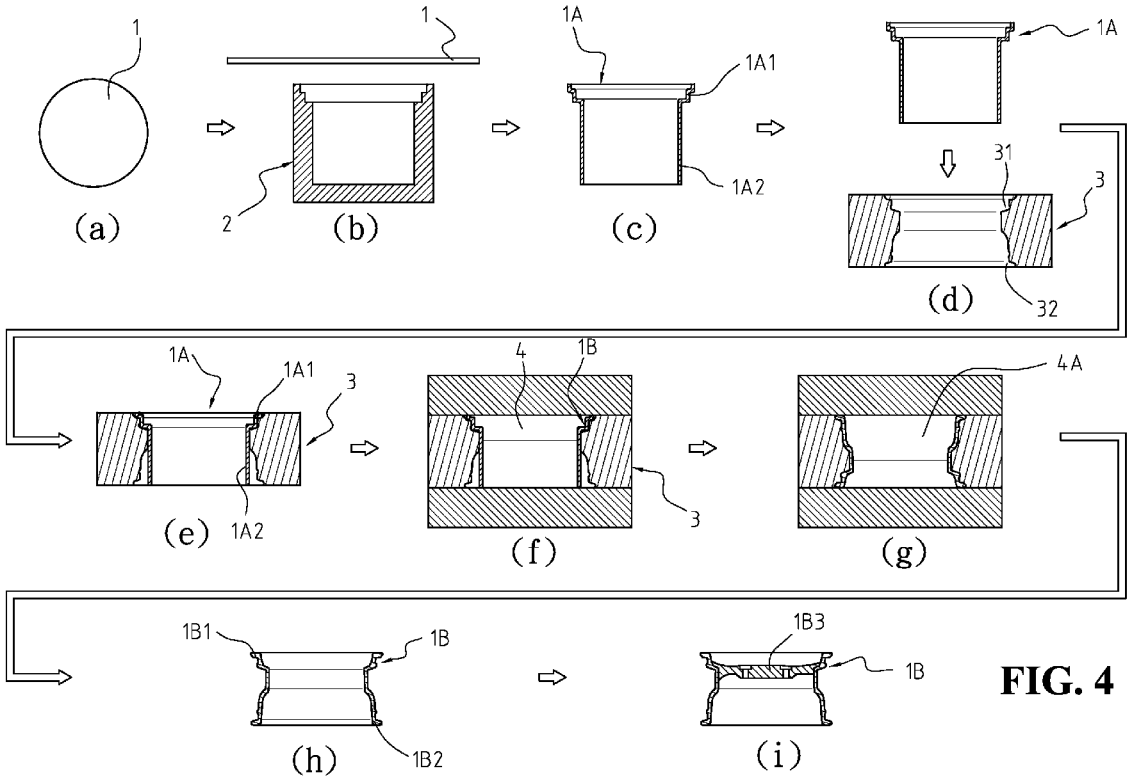
FIG. 4 is a schematic diagram showing a manufacturing process of a method for manufacturing a wheel rim and the structure thereof in accordance with the present invention.

Referring to FIG. 4, a method for shaping a seamless aluminum wheel rim in accordance with the present invention comprises the following steps of:

(1) cutting an aluminum alloy plate into a circular plate 1;

(2) the circular aluminum alloy plate 1 being drew into a cup-shaped embryo body 1A by a deep drawing die 2, wherein an end of the embryo body 1A is shaped into a cup-shaped cylinder 1A2 and the other end thereof is an embryo expansion part 1A1;

(3) the bottom surface of the cup-shaped cylinder 1A2 being punched out to form a hollow cylinder; and (4) the cup-shaped embryo body 1A being put into an expanding-pressing female die 3 with an expanding die cavity respectively at both ends thereof, and then pressed and expanded by two sets of expanding-pressing male dies respectively at both ends of the embryo body 1A to make the embryo expansion part 1A1 and the cylinder 1A2 respectively form a first expansion part 1B1 and a second expansion part 1B2 that construct a wheel rim 1B.

The detailed shaping steps are further described as the followings. As shown in FIGS. 4(*a*)–(*d*), an aluminum-plate (material No. 6061) with a thickness 6–7 mm is selected as a work. It is pre-cut into a circular plate 1. The circular plate J is shaped into a cup-shaped embryo body 1A by a deep drawing die 2, wherein an end of the embryo body 1A is shaped into a cup-shaped cylinder 1A2 and the other end thereof is an embryo expansion part 1A1. The diameter of the embryo expansion part 1A1 is greater than that of the cylinder 1A2. The bottom surface of the embryo body 1A is then punched out by a punch press to form a hollow cylinder. The embryo expansion part 1A1 is not a final expansion part of a wheel rim but a pie-shape similar to a continuous die.

The expanding-pressing female die 3 can be opened in lateral direction. Both ends of the die cavity of the expanding-pressing female die 3 are open and respectively form a first expanding die cavity 31 and a second expanding die cavity 32 (refer to FIG. 4(*d*)). The shaping process comprises that the cylinder 1A2 of die embryo body 1A is inserted from the first expanding die cavity 31 into the second expanding die cavity 32 (referring to FIG. 4(*e*)); a first expanding-pressing male die 4 is extruded by an oil pressure machine into the expanding-pressing female die 3 downwards to make the embryo expansion part 1A1 further be shaped into a final first expansion part 1B1 (referring to FIG. 4(*f*)); next, the embryo body 1A is turned over 180 degrees to make the hollow cylinder 1A2 upwards; a second expanding-pressing male die 4A is extruded by an oil pressure machine into the expanding-pressing female die 3 downwards to make the hollow cylinder 1A2 be shaped into a second expansion part 1B2 (referring to FIG. 4(*g*)); and after opening the expanding-pressing female die 3, a shaped wheel rim 1B (refer to FIG. 4(*h*)) is taken out. In order for the wheel rim 1B to operate after it is mounted to a wheel seat of a vehicle, the wheel rim should be mounted with a wheel disc 1B3 that is mounted to the wheel seat of the vehicle. The wheel disc is not a subject matter of the present invention. Therefore it is not described here.

The manufacturing method of the present invention only uses a set of drawing die and two sets of expanding-pressing dies to shape a seamless aluminum alloy wheel rim. The equipment and manufacturing costs thereof are very low. The wheel rim has a superior performance and very high strength due to seamless.

The above statement is only for illustrating the preferred embodiment of the present invention, and not for giving any limitation to the scope of the present invention. It will be apparent to those skilled in this art that all equivalent modifications and changes shall fall within the scope of the appended claims and are intended to form part of this invention.

What is claimed is:

1. A method for shaping a seamless aluminum wheel rim, comprising the steps of:

(a) cutting an aluminum alloy plate into a circular plate;

(b) drawing said circular plate into a cup-shaped embryo body by a deep drawing die, said cup-shaped embryo body having a first end being shaped into a cup-shaped cylinder and a second end being shaped into an embryo expansion part with a diameter greater than the diameter of said cup-shaped cylinder;

(c) punching out a bottom surface of said cup-shaped cylinder to form a hollow cylinder;

(d) putting said cup-shaped embryo body into an expanding-pressing female die having an expanding die cavity respectively at both ends of said expanding-pressing female die thereof and (e) pressing and expanding said cup-shaped embryo body at both ends of said cup-shaped embryo body by two sets of expanding-pressing male dies respectively to make said embryo expansion part and said hollow cylinder respectively form a first expansion part and a second expansion part that construct a wheel rim.

2. The method for shaping a seamless aluminum wheel rim as claimed in claim 1, wherein the thickness of said aluminum alloy plate is approximately 6 to 7 mm.

* * * * *